United States Patent [19]

Jacobsen et al.

[11] 4,025,019

[45] May 24, 1977

[54] CEILING FIXTURE AND HANGING CLAMP ASSEMBLY

[75] Inventors: Arnold Ralph Jacobsen, Arlington Heights; I. Pompe Jaffe, Skokie, both of Ill.

[73] Assignee: Skyhook Sales Corporation, Niles, Ill.

[22] Filed: Oct. 7, 1976

[21] Appl. No.: 730,327

[52] U.S. Cl. ..... 248/317; 52/39; 248/300

[51] Int. Cl.[2] ..... E04B 1/40; E04B 5/52

[58] Field of Search ..... 248/317, 228, 226 E, 248/72, 340, 343, 300; 24/259 R, 259 TF, 201 S, 230 F; 52/28, 29, 484, 485, 144, 49, 713, 39

[56] References Cited

UNITED STATES PATENTS

| | | | |
|---|---|---|---|
| 1,789,827 | 1/1931 | McKay | 52/484 X |
| 2,017,911 | 10/1935 | Manske et al. | 52/484 |
| 3,601,862 | 8/1971 | Hargadon | 248/317 X |
| 3,612,461 | 10/1971 | Brown | 248/317 |
| 3,618,176 | 11/1971 | Barnes | 248/343 X |
| 3,681,881 | 8/1972 | Baran | 52/29 |
| 3,743,228 | 7/1973 | Drab | 248/228 |
| 3,936,023 | 2/1976 | Clifton | 248/228 |
| 3,952,985 | 4/1976 | Davenport | 248/317 |

*Primary Examiner*—J. Franklin Foss
*Attorney, Agent, or Firm*—Dominik, Knechtel, Godula & Demeur

[57] ABSTRACT

There is disclosed an improved ceiling support fixture and hanging clamp assembly formed by a hanging clamp of the type formed by a V-shaped element providing two upwardly extending legs, each of the legs having a laterally outwardly extending flange portion and a return support flange portion, and a ceiling support fixture formed by an elongated support base terminating at opposed lateral ends, the support base having mount means associated therewith for mounting the same to an overlying support surface, and the ceiling fixture further provided with spacer means associated with the support base to space the support base a distance from the overlying support surface, and the spacer means further functioning to space the support base a distance from the overlying support surface to permit the return support flanges of hanging clamp to be inserted between the support base and the overlying support surface thereby to provide an improved ceiling support fixture and hanging clamp assembly.

5 Claims, 4 Drawing Figures

CEILING FIXTURE AND HANGING CLAMP ASSEMBLY

BACKGROUND OF THE INVENTION

Incident to modern construction, the development of suspended ceilings for both residential and commercial use has become quite commonplace. Generally, such ceilings provide a metallic gridwork which supports a plurality of asbestos tiles which are positioned between the metallic gridwork, and at spaced locations, light fixtures are built into the suspended ceiling. This type of construction has become quite commonplace.

One of the drawbacks incident to the provision of such ceilings has been the difficulty of suspending any structure from the ceiling since the only support structure available for supporting any suspended article is the metallic gridwork. Heretofore, it has been fairly common practice to employ a support of some type which is strung through the suspended ceiling and mounted from the overlying support surface or hard ceiling. In many such applications, the support fixture is clamped to one of the metallic grids and includes an upper portion which is fastened to the overlying support ceiling. For example, a construction of this type is shown in U.S. Pat. No. 3,612,461 wherein a clip is provided which clips to the T bar of the metallic gridwork, and has an upwardly extending portion which provides a point of attachment for a cable or cord of some kind to be attached and suspended from the overlying support ceiling. It will be appreciated, however, that such assemblies are rather cumbersome in terms of use and are difficult to install. In addition, installation requires disassembling a portion of the ceiling in order to gain access above the suspended ceiling and requires that additional apertures or holes be drilled into the overlying support ceiling in order to mount the clips or hanging assemblies properly.

Various recent improvements have been effected on such hanging clamps, and for example, the hanger clips shown in U.S. Pat. No. 3,743,228 represents one of such improvements. As shown in the aforementioned patent, the improved hanger clips assume a V-shaped configuration and include a pair of return support flanges which are intended to clip to the side lateral edges of the T bar forming a portion of the metallic gridwork. Extending downwardly from the V-shaped flanges is a support member having an aperture which is intended to carry the load of the article suspended therefrom. Clips of this type lend themselves to easy installations since the user need only clip the V-shaped flanges having the return support flanges incorporated therein on to the T-shaped metal grid bar forming part of the suspended ceiling. It has further been found that clips of this type will accept a significant load and weights of approximately 50 pounds or more may be suspended from clips of this type. Hence, it has been found that clips of this configuration perform quite adequately for suspending structures such as macrames and the like where the weight of a potted plant must be taken into consideration when employing any particular type of hanger assembly.

Even more recently, a further improvement has been effected in such hanger clips as evidenced by U.S. Pat. No. 3,952,985 wherein a V-shaped hanging clip is disclosed. Once again, the V-shaped hanging clip includes a pair of laterally outwardly extending flange portions having a return support flange portion associated therewith. The clip is installed on the T-shaped metallic grid bar by simply forcing the two V-shaped legs together until the return support flanges associated with each leg overly the T-shaped portion of the metal gridwork. The lower portion of the V-shaped clip includes an aperture which accommodates an S-shaped hook and thereby accommodates the suspension therefrom of any desired object.

It has been found that the hanger clips of the type described above as evidenced by the aforementioned patents perform quite adequately for suspending objects from a suspended ceiling. Nevertheless, it has been found that in many diverse types of construction, a suspended ceiling is provided in only one portion of the building. Hanging clips of the type described are intended to operate only in connection with a suspended ceiling and, therefore, cannot be adapted to any solid overhead ceiling, such as a plaster or plaster board ceiling.

OBJECTS AND ADVANTAGES

It is therefore the principal object of the present invention to provide a ceiling fixture and hanging clamp assembly which permits the hanger clip to be employed in connection with both suspended ceilings as well as flat hard ceilings without, at the same time, requiring the complete removal of the entire assembly in order to move the hanger clip from one location to another.

A further object of this invention is to provide a ceiling support fixture and hanging clamp assembly which is formed by a hanging clamp of the type having a V-shaped element providing two upwardly extended legs wherein each of the legs has a laterally outwardly extending flange portion and a return support flange portion, and a ceiling support fixture formed by elongated support base terminating at opposed lateral ends, the support base having mount means associated therewith permitting the secure mounting of the ceiling support fixture to an overlying support surface, the ceiling support fixture further provided with spacer means associated with the support base and with the mount means such that upon mounting the support base to an overlying support surface, the spacer means functions to space the support base a distance from the overlying support surface sufficient to permit the return support flanges of the hanging clamp to be inserted therein thereby to provide a ceiling support fixture which may be fixedly secured by the mount means to an overlying support surface and to further permit the hanging clamp to be inserted and removed easily from the ceiling support fixture.

Another object of the present invention is to provide a ceiling support fixture and hanging clamp assembly of the type described wherein the spacer means associated with the support base are formed by opposed upturned portions of the lateral ends of the support base such that upon mounting the ceiling support fixture to an overlying support surface, the support base is spaced downwardly a distance from the aforesaid overlying support surface.

Further features of the invention pertain to the particular arrangement of the elements and parts whereby the above-outlined and additional operating features thereof are attained.

The invention, both as to its organization and method of operation, together with further objects and advantages thereof, will best be understood by references to the following specification, taken in connection with the accompanying drawings in which.

BRIEF SUMMARY OF THE INVENTION

Figure 1:
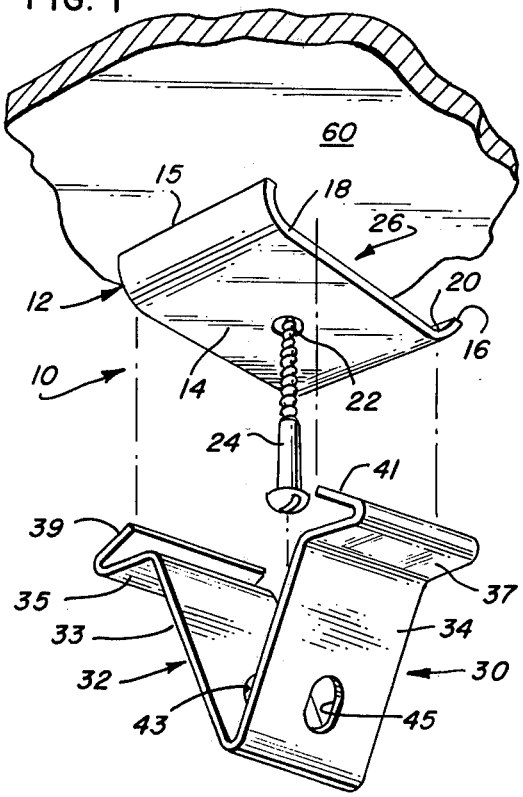
FIG. 1 is a perspective, exploded view showing the ceiling support fixture and hanging clamp assembly in relation to an overlying support ceiling.

The invention described herein is intended to provide a hanging clamp and ceiling support fixture which permits the hanging clamp portion to be utilized in connection with both an overlying support ceiling as well as in connection with a suspended ceiling construction by providing a ceiling support fixture which is fixedly secured to an overlying support ceiling while the hanging clamp portion thereof is removable from the ceiling support fixture and may be utilized in connection with both the ceiling fixture support as well as the suspended ceiling assembly. The ceiling support fixture is constructed as a unitary piece and adapted for fixedly securing same to an overlying support ceiling by any suitable means, such as screw threadedly inserting a screw therethrough and into the overlying support ceiling. The hanging clamp may be removably engaged upon the ceiling support fixture in a manner to permit easy removal therefrom such that the hanger clamp and any structure supported therefrom may be moved from one location to another. In addition, it is intended that the ceiling support fixture may be formed of a material which will accept a household paint such that the fixture may be painted the same color as the overlying support ceiling in order to basically conceal the same when installed. Hence, should the hanging clamp be removed, the ceiling fixture will be relatively unnoticable.

DETAILED DESCRIPTION OF THE INVENTION

As shown in the drawings, the ceiling support fixture and hanging clamp assembly, generally referred to by the numeral 10 is formed basically by a ceiling support fixture 12 which is formed as a unitary element. The ceiling support fixture 12 is formed by an elongated support base 14 which terminates a lateral side edges 15 and 16 respectively. As shown in the drawings; the lateral side edges 15 and 16 respectively are upturned in a direction away from the plane of the support base 14 along curved lines 18 and 20 respectively.

The support base 14 is further provided with an aperture 22 which accommodates the insertion therethrough of a threaded screw 24 to accommodate the mounting of the ceiling support fixture 12 to the overlying ceiling 16.

As shown in FIGS. 1 through 4 of the drawings, the upturned lateral edges 15 and 16 of the ceiling support fixture 12 function as spacer means for spacing the support base 14 a distance away from the overlying support ceiling 60. Hence, to mount the ceiling fixture 12 to the ceiling 60, the fixture 12 is mounted such that the support base 14 is spaced downwardly away from the ceiling 60 by means of the upturned lateral edges 15 and 16 of the ceiling support fixture 12 thereby to function as spacer means. As such, an opening or space represented by the numeral 26 is provided between support base 14 and the overlying support ceiling 60.

As further shown in the drawings, the hanging clamp, generally referred to by the numeral 30 is shown to be formed as a V-shaped element generally represented by the numeral 32, and formed by a pair of legs 33 and 34 respectively. Each leg 33 and 34 is shown to include a laterally outwardly extending flange portion 35 and 37 respectively, and terminates at a return support flange portion 39 and 41 respectively.

As is apparent from the drawings, the hanging clamp 30 is formed of a bendable or malleable material thereby to permit the V-shaped legs 33 and 34 to be bent toward one another, or alternatively, to be unbent to permit the opening and closing of the V-shaped element 32. Materials which have been found to function efficiently for purposes of the hanging clamp 30 include aluminum alloys or steel and aluminum alloys which are sufficiently hard to support a fixture or other element to be suspended therefrom, while alternatively permitting the user to open and close the V-shaped element 32 forming the hanging clamp 30.

Figure 2:
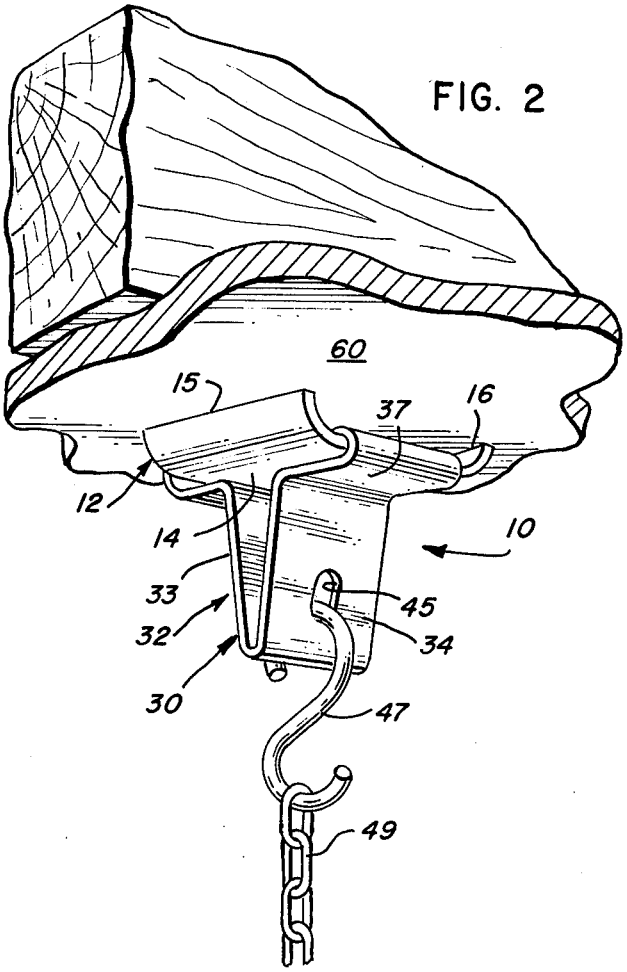
FIG. 2 is a perspective view showing the entire assembly including the ceiling support fixture and hanging clamp mounted to an overlying support ceiling and having suspension chain associated therewith.
Figure 3:
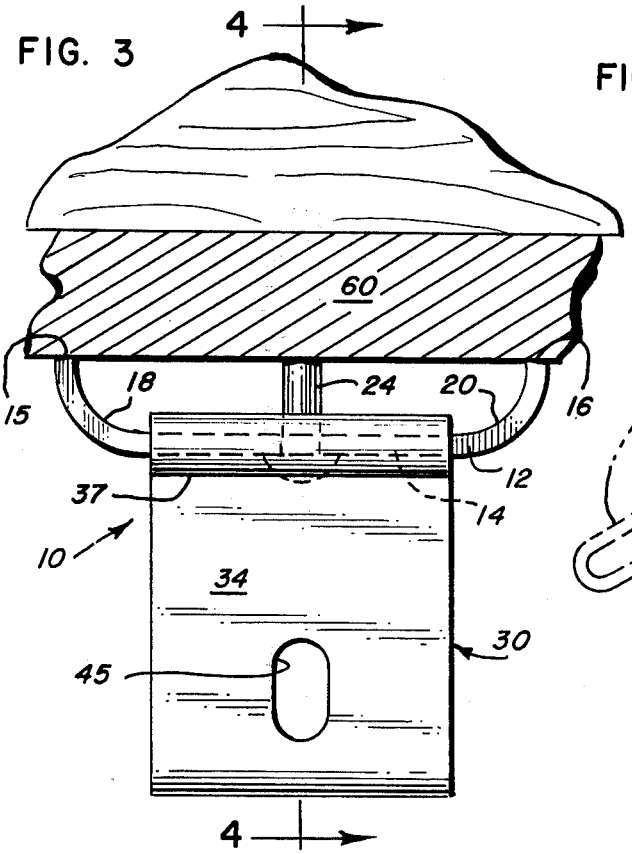
FIG. 3 is a side elevational view showing the manner in which the ceiling support fixture and hanging clamp assembly are interconnecting and further, the manner in which the entire assembly is mounted to an overhead ceiling.

The hanging clamp 30 further includes a pair of apertures 43 and 45 respectively positioned in each of the legs 33 and 34 of the V-shaped element 32. As is shown in FIG. 2 of the drawings, once the V-shaped element 32 has the corresponding legs 33 and 34 pressed together in the supported posture, the apertures 43 and 45 are in alignment and permit the insertion therein of an S-shaped hook 47. The lower portion of the S-shaped hook 47 accommodates any table or chain 49 to be suspended therefrom again as shown in FIG. 2 of the drawings. The suspension chain 49 in turn, holds any fixture or other element to be suspended from the assembly 10, such as for example, a potted plant or other similar article.

Figure 4:
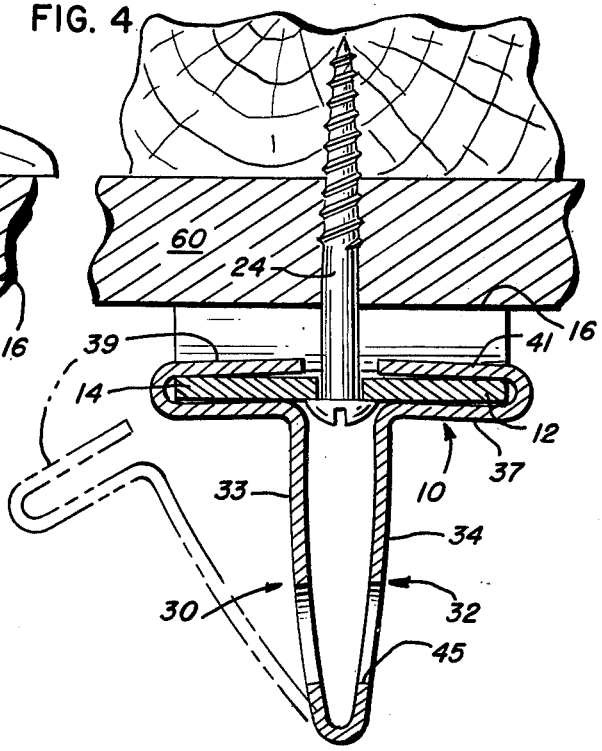
FIG. 4 is a side elevational view of the ceiling support fixture and hanging clamp assembly, taken in the direction of the arrows along the line 4—4 of FIG. 3.

As further shown in the drawings, the hanging clamp 30 is supported from the ceiling support fixture 10 by opening the V-shaped element 32 forming the hanging clamp 30 by spreading the corresponding legs 33 and 34 a distance greater than the width of the ceiling support fixture 12. With the hanging clamp 30 in the open position, the hanging clamp 30 is supported from the corresponding ceiling support fixture 12 by inserting the side edges of the support bass 14 between the respective laterally outwardly extending flange portions 35 and 37 and the corresponding return support flange portions 39 and 41 respectively. This configuration is shown in FIGS. 2 and 4 of the drawings in particular. The hanging clamp 30 is supported from the ceiling support fixture 12 by pressing the legs 33 and 34 together, and due to the malleability of the material forming the hanging clamp 30, the legs 33 and 34 will not only bend toward one another, but will remain in the bent and supporting posture as shown in FIGS. 2 and 4. As particularly shown in FIG. 4 of the drawings, the ceiling support fixture 12 is mounted to the overlying support ceiling 60 by means of a threaded screw 24 which is inserted through the aperture 22 and driven directly into the ceiling 60. This manner of mounting the ceiling support fixture 12 affords a relatively permanent and secure mounting of the ceiling support fixture 12 such as to permit relatively heavy weights to be suspended from the hanging clamp 30. It will further be observed that the upturned lateral edges 15 and 16 of the support base 14 function to space the support base 14 downwardly and away from the overlying support ceiling 60 in order to permit sufficient room for the return support flange portions 39 and 41 of the hanging clamp 30 to be inserted therein. Once again, due to the bendability or malleability of the material forming the hanging clamp 30, once the respective legs 33 and 34 are pressed together, such that the return support flange portions 39 and 41 are positioned above the support base 14 of the ceiling support fixture 12, the hanging clamp 30 then assumes a support posture.

It will also be appreciated that the hanging clamp 30 forming a portion of the assembly 10 may be removed from the ceiling support fixture 12 simply by spreading apart the corresponding legs 33 and 34 of the V-shaped element 32 and removing the hanging clamp 30 from the ceiling support fixture 12. It will also be appreciated that due to the configuration of the hanging clamp 30, the same may be employed in connection with a typical suspended ceiling by employing the laterally outwardly extending flange portions 35 and 37 in conjunction with the return support flange portions 39 and 41 to envelope or sandwich therebetween the T-shaped portions of the T bar forming a portion of the metallic gridwork associated with suspended ceilings. This type of configuration is shown in the patents referred to hereinabove.

The principal advantage derived by the assembly in the present invention is that the ceiling support fixture 12 may be fixedly secured to any overlying support ceiling 60 in the manner shown herein, as a relatively permanent fixture. It is contemplated that the ceiling support fixture 12 is manufactured of a metallic material which will accept normal household paint such that the ceiling support fixture 12 may be decorated by painting the same in the same color as the overlying support ceiling 60. In this manner, should the hanging clamp 30 be removed from the ceiling support fixture 12, the fixture 12 will not be noticeable and hence, may be left in position indefinitely. Simultaneously, the hanging clamp 30 may be employed in any other location or may be used in conjunction with a variety of ceiling support fixtures 12 located in other rooms or locations without the need for constantly having to move the same ceiling support fixture 12 from one location to the next. Hence, the article to be suspended therefrom may be moved from one location to another with relative ease by the user once the sufficient number of ceiling support fixtures 12 have been installed in the desired locations.

It will, therefore, be appreciated that the present invention provides a convenient ceiling support fixture and hanging clamp assembly which may be employed in conjunction with standard flat hard ceilings formed of either plaster or plasterboard, while the hanging clamp portions thereof may be moved from the ceiling support fixture and employed in connection with a standard suspended ceiling arrangement. Hence, a higher degree of versatility for the assembly is permitted as a result of the assembly defined herein. It will also be appreciated that the present invention provides a hanging assembly for use in conjunction with both types of hard flat ceilings and suspended ceilings thereby to give the ultimate user the highest degree of versatility for suspending structures from any given ceiling.

It will also be appreciated that the present invention provides a ceiling fixture and hanging clamp assembly which is relatively economical in terms of cost while yet permitting the widest latitude of ease of use.

While there has been described what is at present considered to be the preferred embodiments of the invention, it will be understood that various modifications may be made therein and it is intended to cover in the appended claims all such modifications as fall within the true spirit and scope of the invention.

What is claimed is:

1. An improved ceiling support fixture and hanging clamp assembly comprising in combination, a hanging clamp of the type formed by a V-shaped element providing two upwardly extending legs, each of the legs having a laterally outwardly extending flange portion and further provided with a return support flange portion, said laterally outwardly extending flange portions and return support flange portions constructed and adapted to permit insertion of a ceiling support fixture therebetween, a ceiling support fixture formed by an elongate support base terminating at opposed lateral ends, said support base having mount means associated therewith for permitting the secure mounting of said ceiling support fixture to an overlying support surface, said ceiling support fixture further provided with spacer means associated with said support base and said mount means such that upon mounting said support base upon an overlying support surface, said spacer means functions to space said support base a distance from said overlying support surface, said spacer means further functioning to space said support base from said overlying support surface a distance sufficient to permit said return support flanges of said hanging clamp to be inserted between said support base and said overlying support surface, whereby said ceiling support fixture may be fixedly secured by said mount means to an overlying support surface and said support base provides a support surface for supporting said hanging clamp by positioning said support base between said laterally outwardly extending flange portions and said return support flange portions of said hanging clamp whereby said clamp may be hung from and supported by said ceiling support fixture thereby to provide a hanging assembly for supporting a variety of articles therefrom.

2. The ceiling support fixture and hanging clamp assembly as set forth in claim 1 above, wherein said spacer means associated with said support base and said mount means is formed by opposed upturned portions of the lateral ends of said support base.

3. The ceiling support fixture and hanging clamp assembly as set forth in claim 2 above, wherein said mount means is formed by an aperture provided in said support base and a threaded screw sized to pass through said aperture and into said overlying support surface with said upturned lateral ends interposed between said overlying support surface on said support base such that said support base is spaced from said overlying support surface a distance equal to the length of said upturned lateral ends of said support base.

4. An improved ceiling support fixture and hanging clamp assembly comprising in combination, a hanging clamp of the type formed by a V-shaped element providing two upwardly extending legs, each of the legs having a laterally outwardly extending flange portion and further provided with a return support flange portion, said laterally outwardly extending flange portions and return support flange portions constructed and adapted to permit insertion of a support fixture therebetween, a ceiling support fixture formed by an elongate support base terminating at opposed lateral ends, said opposed lateral ends each having an upturned spacer portion formed integrally thereon, said upturned spacer portion being adapted to space said support base a distance below an overlying support surface, said spacer portions spacing said support base a distance sufficient to permit said return support flange positions of said hanging clamp to be inserted between said support base and said overlying support surface, and mount means associated with said ceiling support fixture for permitting the secure mounting of said ceiling fixture to an overlying support surface, whereby said ceiling support fixture may be fixedly secured by said mount means to an overlying support surface and said support base provides a support surface for supporting said hanging clamp by positioning the said support base between said laterally outwardly extending flange portions and said return support flange portions of said hanging clamp whereby said clamp may be hung from and supported by said ceiling support fixture thereby to provide a hanging assembly for supporting a variety of articles therefrom.

5. The ceiling support fixture and hanging clamp assembly as set forth in claim 4 above, wherein said mount means comprises an aperture formed in said support base, and a threaded screw adapted and sized to pass through said aperture and into said overlying support surface with said upturned spacer portion interposed between said support base and said overlying support surface thereby to provide a space therebetween to accommodate the insertion therein of said return support flange portions of said hanging clamp therein.

* * * * *